US005679206A

United States Patent [19]

Glass

[11] Patent Number: 5,679,206

[45] Date of Patent: Oct. 21, 1997

[54] APPARATUS AND METHOD FOR SEPARATING A TAIL FROM ROLLED MATERIAL

[75] Inventor: William C. Glass, Junction City, Oreg.

[73] Assignee: The James River Corporation of Virginia, Richmond, Va.

[21] Appl. No.: 396,149

[22] Filed: Feb. 28, 1995

[51] Int. Cl.[6] ..... B65H 19/00

[52] U.S. Cl. ..... 156/446; 156/458; 156/578; 156/184; 242/548.4

[58] Field of Search ..... 242/532.2, 533.4, 242/535.1, 541.2, 542, 548.4; 156/446, 448, 449, 450, 457, 458, 184, 187, 191, 193, 578

[56] References Cited

U.S. PATENT DOCUMENTS

| | | |
|---|---|---|
| 1,369,124 | 2/1921 | Pope . |
| 2,261,971 | 11/1941 | Matthews . |
| 2,529,184 | 11/1950 | Pearson . |
| 3,393,105 | 7/1968 | Tellier, Jr. . |
| 3,756,527 | 9/1973 | Collins et al. . |
| 3,770,266 | 11/1973 | Wehr et al. . |
| 4,025,009 | 5/1977 | Fineo . |
| 4,026,752 | 5/1977 | Hartbauer et al. . |
| 4,299,642 | 11/1981 | Berkholtz . |
| 4,466,578 | 8/1984 | Shibuya et al. . |
| 4,475,974 | 10/1984 | Perini ..... 156/187 |
| 4,485,981 | 12/1984 | Krywiczanin et al. . |
| 4,531,723 | 7/1985 | Watson . |
| 4,575,298 | 3/1986 | Maas et al. . |
| 4,581,083 | 4/1986 | Schutz et al. . |
| 4,693,766 | 9/1987 | Stauffer . |
| 4,984,750 | 1/1991 | Shigeta et al. . |
| 5,169,082 | 12/1992 | da Silva et al. . |
| 5,308,005 | 5/1994 | Hutteman et al. . |
| 5,354,007 | 10/1994 | Fissmann et al. . |

*Primary Examiner*—James Engel

*Attorney, Agent, or Firm*—Finnegan, Henderson, Farabow, Garrett & Dunner, L.L.P.

[57] ABSTRACT

An apparatus and method for separating a tail from a roll of material. The apparatus includes a rotator for rotating a roll of material about its longitudinal axis and a tail loosener for loosening a tail from the roll. Air flowing from a duct passes over a tail supporting surface to extend the tail along the surface. The apparatus may be used to arrange a tail before the tail is sealed to the roll.

20 Claims, 3 Drawing Sheets

APPARATUS AND METHOD FOR SEPARATING A TAIL FROM ROLLED MATERIAL

BACKGROUND OF THE INVENTION

1. Field of the Invention

The present invention relates to an apparatus and method for separating a tail from rolled material. More particularly, the present invention relates to an apparatus and method for separating a tail from a roll of material so that adhesive may be applied to the tail.

2. Description of Related Art

Consumer demand for rolled paper products, such as toilet tissue and paper towels, is enormous. In order to meet this great demand, manufacturing machinery and methods for rapidly fabricating these products must be constantly improved. Tissue and paper towel manufacturers have reduced the stiffness of products to create a product having improved softness that is pleasing to a user, but because this material is extremely pliant and capable of being torn with very little force, improvement of existing high speed manufacturing technology is extremely challenging.

During the manufacture of a rolled material, such as toilet tissue or paper towels, machinery winds the material into a long roll that is eventually cut into smaller length sections and then packaged for consumer use. However, before this cutting and packaging process takes place, the tail or free end of the roll must be properly sealed to the roll to prevent unrolling. Some current manufacturing devices do not reliably perform this function because the tail may become folded or wrinkled before adhesive is applied.

Improperly sealed tails present a number of different problems. An unsealed tail may jam machinery requiring a temporary pause in a normally rapid manufacturing assembly line. In addition this unsealed free end may protrude from a package creating an unsightly product. Further, when a tail is wrinkled or folded before being sealed to a roll the tail material may inhibit packaging and dispensing.

U.S. Pat. Nos. 3,393,105; 4,026,752; 4,299,642; and 4,693,766 each disclose a tail sealing device, however these devices lack adequate structure for arranging a tail to ensure that it does not fold over or wrinkle before being sealed to a roll.

In light of the foregoing, there is a need in the art for a device and method for improving tail sealing.

SUMMARY OF THE INVENTION

Accordingly, the present invention is directed to an apparatus and method for arranging a tail of material that substantially obviates one or more of the limitations of the related art.

Further the invention is directed to an apparatus and method for straightening a tail of material before an adhesive is applied to the tail.

To achieve these and other advantages and in accordance with the purpose of the invention, as embodied and broadly described herein, the invention includes an apparatus and method for arranging the tail from a roll of material. The apparatus comprises a rotator for rotating a roll of material about a longitudinal axis of the roll, a tail loosener for loosening the tail from a roll of material being rotated by the rotator, a tail supporting surface positioned adjacent to the rotator, and at least one air duct positioned to flow air over the tail supporting surface in a direction facing generally away from the roll being rotated by the rotator.

In another aspect, the invention includes a means for rotating a roll of material about a longitudinal axis of the roll, means for loosening a tail from the roll, a tail supporting surface, and means for extending the tail along the tail supporting surface.

Additionally, the present invention includes a method for arranging a tail from a roll of material. The method comprises the steps of loosening a tail from a roll of material, flowing air over a tail supporting surface, and extending the tail along the surface with an air flow generated in the flowing step.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention and are incorporated in and constitute a part of this specification. The drawings illustrate embodiments of the invention and, together with the description, serve to explain the principles of the invention. In the drawings.

DESCRIPTION OF THE PREFERRED EMBODIMENT

Reference will now be made in detail to the present preferred embodiments of the invention, an example of which is illustrated in the accompanying drawings.

Figure 5:
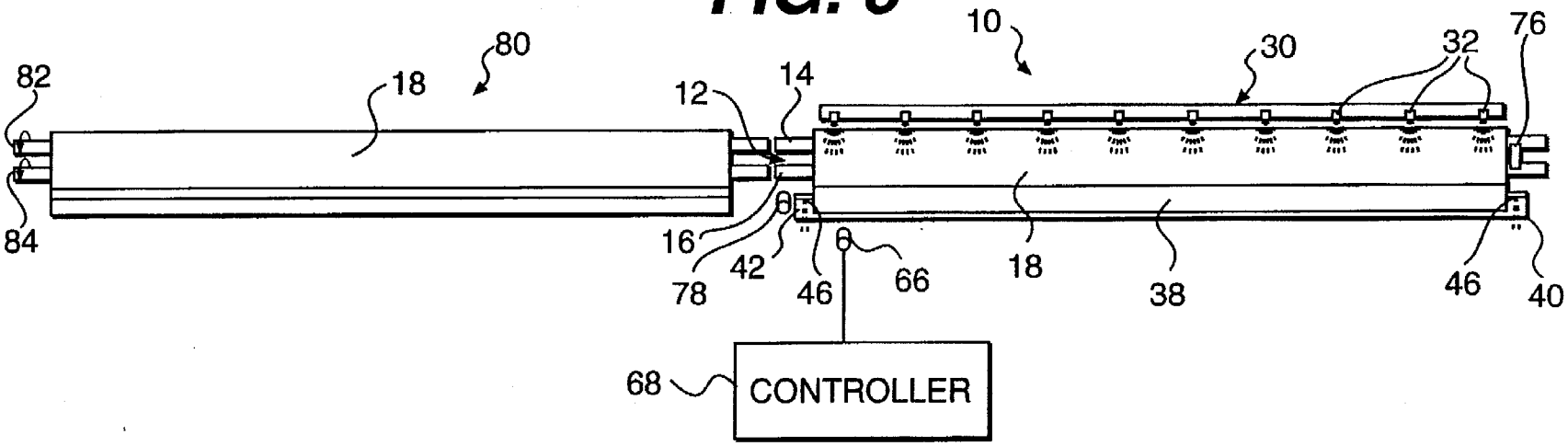
FIG. 5 is a schematic top view of the embodiment of FIG. 1 including a tail winding station.

In accordance with the invention, there is provided an apparatus for separating a tail from a roll of material, the apparatus including a rotator for rotating the roll about the longitudinal axis of the roll. As embodied herein and as illustrated in FIGS. 1 and 5, the apparatus 10 includes a rotator 12 having a pair of trunion rollers 14, 16 for rotating a roll 18 of material placed on the rollers 14, 16 about its longitudinal axis in a first rotational direction indicated by the arrow labelled A in FIG. 1.

Figure 1:
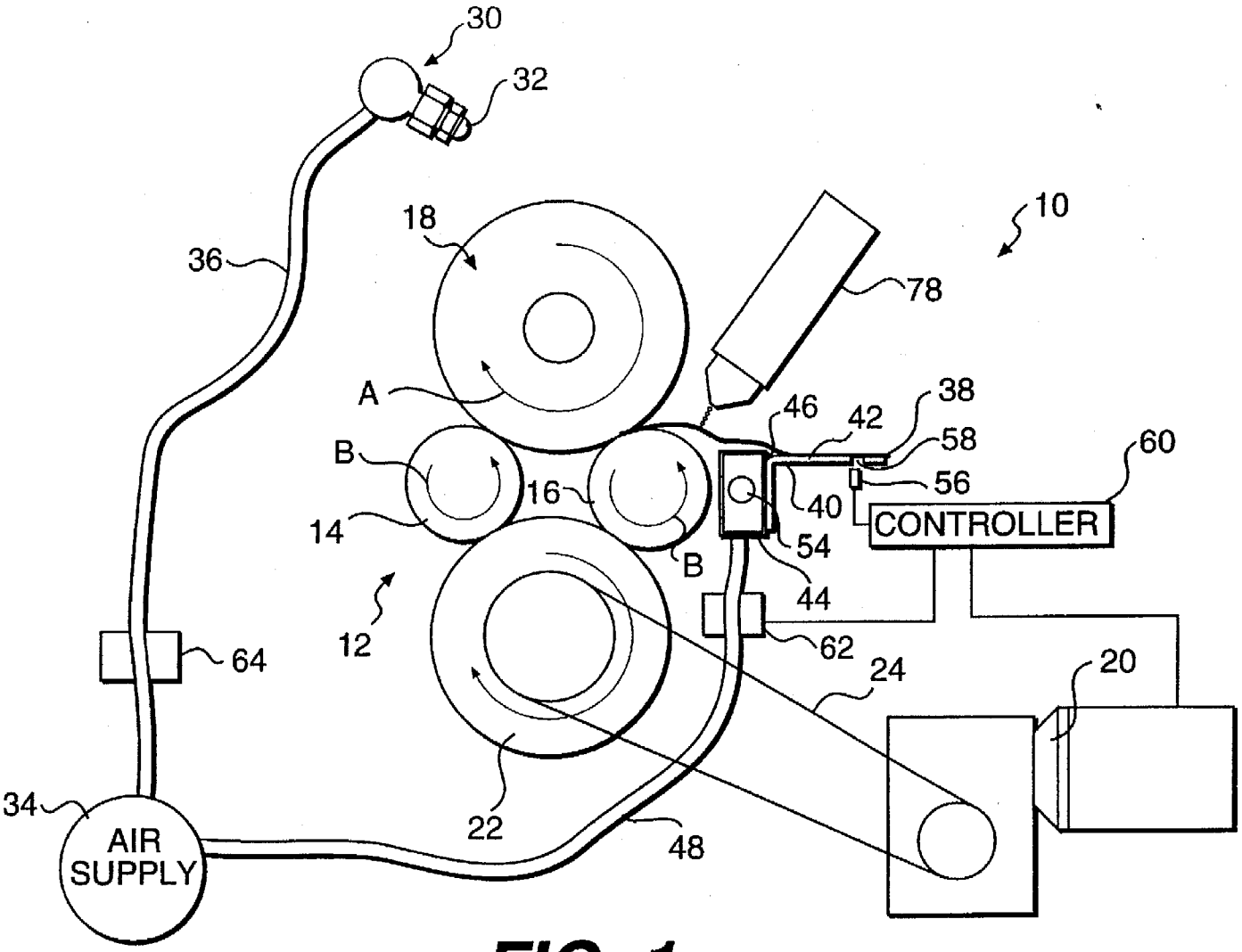
FIG. 1 is a partially schematic side view illustrating an embodiment of the invention with a tubular member and tail support being shown in cross section.
Figure 2:
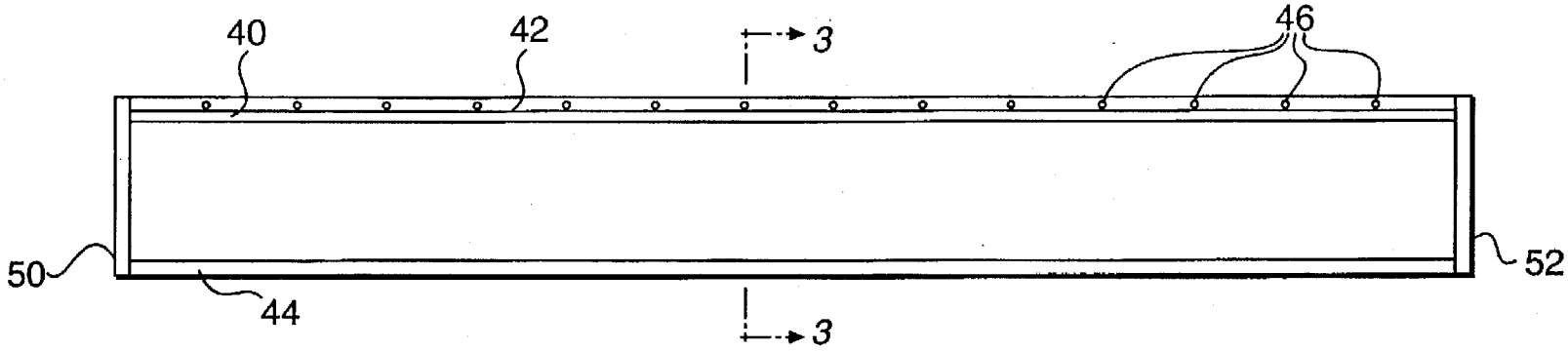
FIG. 2 is a front view of the tubular member and tail support shown in FIG. 1.
Figure 3:
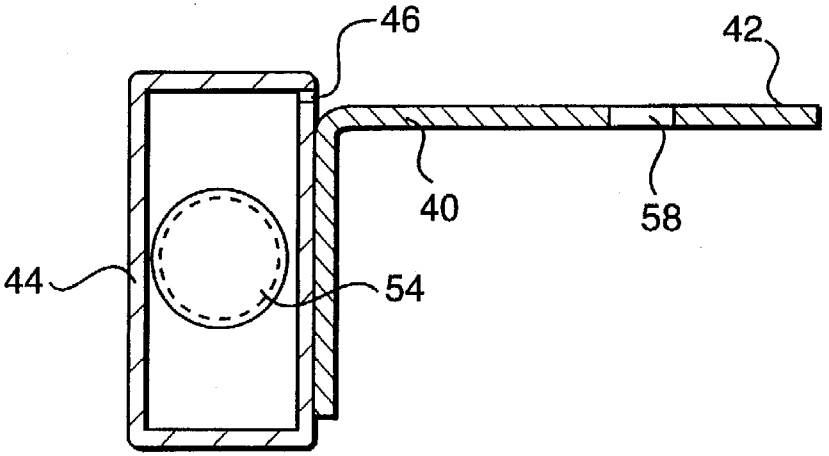
FIG. 3 is a cross sectional view taken along line 3—3 of FIG. 2.

A motor 20 coupled to the trunion rollers 14, 16 through a driving gear 22 and belt 24 turns the trunion rollers 14, 16 in a second rotational direction indicated by the arrow labelled B in FIG. 1. Preferably, this motor 20 is controlled by a controller 60, as described below. It will be evident to those of ordinary skill in the art that particular elements of the rotator 12 may be modified without departing from the scope of the invention. In particular, the trunion rollers 14, 16 may be rotated without using a driving gear 22 and belt 24 or the roll 18 may be rotated without the use of trunion rollers 14, 16.

The roll 18 may be made up of a material such as natural or synthetic fiber cloths, plastic films, metallic foils, or single layer or multiple layer laminate papers. In the preferred practice of the invention, the roll 18 is either toilet tissue or paper toweling having a length of approximately 90 inches. If the roll 18 is a toilet tissue material, the roll 18 will be eventually cut into smaller sections measuring approximately 4.5 inches in length to allow for proper packaging.

In accordance with the invention, a tail loosener is provided for loosening a tail from the roll of material being rotated by the rotator. As embodied herein and shown in FIGS. 1 and 5, the apparatus 10 includes a tail loosener 30 having a series of nozzles 32 coupled to a compressed air supply 34 through a hose 36. The nozzles 32 direct a blast of air toward the unsealed roll 18 of material, as shown in FIG. 5, to loosen (unroll) a tail 38 or free end from the roll 18, so that the tail 38 falls toward a tail support 40. Thereafter, the blast of air from the nozzles 32 automatically terminates, as described below.

In accordance with the invention, a tail supporting surface is positioned adjacent to the rotator. As embodied herein and shown in FIGS. 1–3 and 5, the tail support 40 positioned adjacent to the rotator 12 has a tail supporting surface 42 along the top of the tail support 40. In the preferred embodiment this tail supporting surface 42 is a flat planar surface positioned at a height slightly below the top of the trunion rollers 14, 16 in a horizontal orientation parallel to the trunion rollers 14, 16. Although the tail support 40 and tail supporting surface 42 are depicted as being planar, the support 40 and/or surface 42 may be modified with a non-planar profile such as an air foil shape without departing from the scope of the invention. Additionally, the support 40 and/or surface 42 may be positioned without being horizontal to the trunion rollers 14, 16.

In accordance with the invention, at least one air duct is positioned to direct a flow of air over the tail supporting surface in a direction facing generally away from a roll being rotated by the rotator. As embodied herein and shown in FIGS. 1–3 and 5 the tail support 40 is attached to a tubular member 44, so that the tail supporting surface 42 extends away from the tubular member 44. As shown in the drawings, in a preferred embodiment the tubular member 44 has a rectangular cross section, however, the cross section of the tubular member 44 may have a variety of different shapes. The tubular member 44 is positioned as close as possible to the trunion rollers 14, 16 and has a plurality of air ducts 46 formed by equally spaced small diameter holes in a wall of the tubular member 44 and located at a position above the tail supporting surface 42.

The tubular member 44 is coupled to the compressed air source 34 by a conduit 48. In a preferred embodiment, both ends 50, 52 of the tubular member 44 have an aperture 54 interconnected to the conduit 48, however the tubular member 44 may be connected to the conduit 48 in any fashion that allows for sufficient air flow. With this arrangement air flows through the tubular member 44, out of the air ducts 46, and over the tail supporting surface 42 in a direction facing generally away from the roll 18 of material being rotated by the rotator 12.

Each of the air ducts 46 is orientated to direct a flow of air parallel to the tail supporting surface 42. This flow of air from the air ducts 46 extends the tail 38 along the tail supporting surface 42 by generating two forces. A first force acts parallel to the tail supporting surface 42 to pull the tail 38 away from the roll 18 of material. This first force acts against the movement of the tail 38 toward the roll 18 of material as the rotating roll 18 winds the tail 38 onto the roll 18. Additionally, a second perpendicular force, created when the air flowing under the tail 38 generates areas of reduced pressure under the tail 38, urges the tail 38 toward the tail supporting surface 42. Thus, the air flowing from the ducts 46 tends to straighten the tail 38 so that the possibility of wrinkling or folding of the tail 38 is reduced.

Although in the preferred embodiment, the air ducts 46 are holes orientated parallel to the tail supporting surface 42, the configuration of the ducts 46 may be varied without departing from the scope of the invention. In particular the orientation of the ducts 46 may be changed or separate nozzles may be substituted for the holes. Additionally a single elongated aperture may be substituted for the plurality of air ducts 46.

In accordance with the invention, the apparatus may include a sensor for detecting a tail at the tail supporting surface. As embodied herein and shown in FIG. 1, a tail sensor 56 is positioned beneath a hole 58 in the tail support 40 to detect when a tail 38 is present at the tail supporting surface 42. The tail sensor 56 is preferably a retroflective bifurcated fiber optic sensor or photoeye for detecting when the tail 38 covers the hole 58, however this element may be any detector capable of sensing the presence of the tail 38.

This tail sensor 56 inputs information to a first controller 60 for controlling the motor 20 and a pneumatic valve 62 positioned in the conduit 48. When the controller 60 receives a input from the tail sensor 56 indicating the presence of the tail 38, the motor 20 is deactivated to terminate rotation of the trunion rollers 14, 16 and the valve 62 is closed to prevent the flow of air through conduit 48. Therefore this controller 60 regulates rotation of the roll 18 of material and the flow of air through the ducts 46. Additionally the controller 60 may also close a pneumatic valve 64 after receiving an input from the tail sensor 56 to prevent the flow of air through hose 36.

The location of the hole 58 and tail sensor 56 may be varied depending upon the desired tail length that should be detected before terminating rotation of the roll 18 of material and flow of air from the air ducts 46. Although a single hole 58 and single tail sensor 56 are depicted, any number of these elements may be incorporated without departing from the scope of the invention.

As depicted in FIG. 5, the invention may also include a roll sensor 66 for detecting the presence or absence of the material roll 18 at the trunion rollers 14, 16. This roll sensor 66 is preferably a photoeye or convergent beam photodetector that provides input to a second controller 68 for controlling the valves 62, 64. More particularly the controller 68 opens the valves 62, 64 to allow the flow of air, respectively, through the conduit 48 and hose 36 when a roll 18 is present at the trunion rollers 14, 16.

Although multiple controllers 60, 68 are disclosed herein, it is within the scope of the present invention to incorporate these controllers into a single controller or to provide additional controllers. In a preferred embodiment the controllers 60, 68 control valves 62, 64, however these controllers 60, 68 may, alternatively, control the compressed air supply 34. In addition flow regulators may be placed in the conduit 48 and hose 36 to regulate air flow rates.

In accordance with the invention, there is also provided a method for arranging a tail from a roll of material. This method is explained below with reference to the embodiments described above. However, it should be understood that the method of the invention is not limited to the structure disclosed herein.

Figure 4:
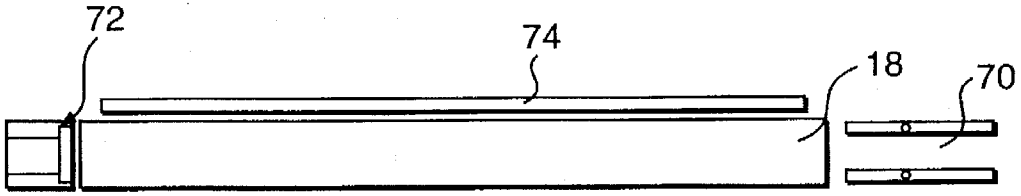
FIG. 4 is a schematic view illustrating a pusher for moving an unsealed roll of material into the position shown in FIG. 1.

In accordance with the present invention and with reference to FIG. 4, an unsealed roll 18 of material, preferably toilet tissue or paper toweling, is transported along a conveyor 70 after being wound on a rewinder (not shown) and stripped off a mandrel (not shown). After contacting a stop switch 72, a pusher 74 forces the roll 18 perpendicular to the direction of travel of the conveyor 70 and into position on the rotating trunion rollers 14, 16 as shown in FIGS. 1 and 5.

While the roll 18 is being rotated about its longitudinal axis by the trunion rollers 14, 16 the controller 68 receives an input from the roll sensor 66, indicating that a roll 18 is present. The controller 68 opens the valves 62, 64 to cause air to flow from the compressed air supply 34 through the nozzles 32 and ducts 46.

The tail 38 is loosened from the roll 18 by directing air from the nozzles 32 toward the rotating roll 18 to unroll the tail 38. While the tail 38 is being loosened, air flows from the ducts 46 over the tail supporting surface 42 in a direction facing generally away from the rotating roll 18. The tail 38 falls toward the tail supporting surface 42 as a result of the air blast from the nozzles 32, rotation of the roll 18 and the influence of gravity.

When the tail 38 approaches the supporting surface 42 the air flowing from the ducts 46 extends the tail 38 along the support surface 42. This air flow forces the tail 38 away from the roll 18 in a direction to oppose the winding of the tail 38 onto the roll 18 while the roll 18 is rotated in the direction A. In addition the air flowing from the ducts 46 forces the tail 38 toward the tail supporting surface 42 when the air flowing underneath the tail 38 generates areas of low pressure beneath the tail 38. The air flow thus straightens the tail 38 along the supporting surface 42.

When the air flow extends the tail 38 a sufficient distance along the tail supporting surface 42 the tail sensor 56 inputs a signal to the first controller 60. The controller 60 then deactivates motor 20 to terminate rotation of the roll 18 and closes the valve 62 to discontinue the air flow from ducts 46. Optionally, the controller 60 may also close the valve 64 to discontinue air flow from nozzles 32. Thereafter the straightened tail 38 rests on the tail support surface 42.

A mover 76 then moves the roll 18 and extended tail 38 longitudinally under a sprayer 78 that applies adhesive to the tail 38. The sprayer 78, as shown in FIG. 5, is positioned at a location so that it does not interfere with positioning of the tail 38. Although the sprayer 78 is positioned at a fixed location in the preferred embodiment, the sprayer 78 may be movable to apply adhesive to the tail 38 without moving the roll 18 with the mover 76.

After the adhesive is applied the mover 76 transfers the roll 18 to a winding station 80 having a pair of rotating rollers 82, 84 while the tail 38 remains in an extended position. These rollers 82, 84 roll the tail 38 onto the roll 18 to seal the tail 38 into a rolled position with the adhesive. Because the tail 38 remains at least partially extended from the roll 18 up until the time when the tail 38 is sealed, the possibility of improper sealing is significantly reduced.

After the tail 38 is sealed to the roll 18, the roll 18 may be cut into smaller sections and then packaged for shipment.

It will be apparent to those skilled in the art that various modifications and variations can be made to the structure and methodology of the present invention without departing from the scope or spirit of the invention.

In a preferred embodiment of the invention, the invention is incorporated into tail sealing machinery manufactured by the Karnel Corporation, however the invention is not intended to be limited to this particular embodiment. The invention may be practiced with any type of tail sealing machinery or with any other type of machinery for performing functions involving material having a tail.

In view of the foregoing, it is intended that the present invention cover modifications and variations of this invention provided they fall within the scope of the following claims and their equivalents.

What is claimed is:

1. An apparatus for separating a tail from a roll of material, the apparatus comprising:

a rotator for rotating a roll of material about a longitudinal axis of the roll;

a tail loosener for loosening a tail from a roll of material being rotated by the rotator;

a tail supporting surface positioned adjacent to the rotator; and at least one air duct positioned to flow air over the tail supporting surface, the air duct facing in a direction generally away from the roll being rotated by the rotator so that air blown from the air duct does not contact the roll being rotated by the rotator.

2. The apparatus of claim 1, wherein the surface is substantially planar and the air duct is positioned to flow air generally parallel to the surface.

3. The apparatus of claim 1, further comprising a plurality of air ducts, each of the air ducts being positioned to flow air over the surface in a direction generally facing away from the roll being rotated by the rotator.

4. The apparatus of claim 1, further comprising a tail sensor for detecting a tail at the tail supporting surface.

5. The apparatus of claim 4, wherein the tail supporting surface has a hole and the sensor is positioned beneath the surface to detect when the tail covers the hole.

6. The apparatus of claim 4, further comprising a conduit for coupling the air duct to a source of compressed air and control means for controlling the flow of compressed air in the conduit based on a signal from the sensor.

7. The apparatus of claim 4, further comprising means for controlling the tail loosener, the tail loosener controlling means receiving a signal from the sensor to control the tail loosener based on the signal.

8. The apparatus of claim 4, further comprising means for controlling the rotator, the rotator controlling means receiving a signal from the sensor to control rotation of a roll at the rotator based on the signal.

9. An apparatus for separating a tail from a roll of material, the apparatus comprising:

a rotator for rotating a roll of material about a longitudinal axis of the roll:

a tail loosener for loosening a tail from a roll of material being rotated by the rotator:

a tubular member capable of being coupled to a compressed air source;

a tail supporting surface positioned adjacent to the rotator, the tail supporting surface extending from the tubular member; and at least one air duct positioned to flow air over the tail supporting surface in a direction facing generally away from the roll being rotated by the rotator, the air duct being a hole formed in a wall of the tubular member.

10. The apparatus of claim 9, wherein the tubular member includes a plurality of air ducts, each of the air ducts being holes formed in the wall of the tubular member to flow air over the surface in a direction facing generally away from the roll being rotated by the rotator.

11. A method for arranging a tail from a roll of material, the method comprising the steps of:

loosening a tail from a roll of material;

directing a flow of air over a tail supporting surface; and extending the tail along the surface by flowing the air between the tail and the tail supporting surface.

12. The method of claim 11, wherein the step of loosening includes rotating the roll of material in a direction such that the tail winds onto the roll and the step of extending includes forcing the tail away from the roll against the winding.

13. The method of claim 11, wherein the step of extending includes forcing the tail toward the tail supporting surface.

14. The method of claim 11, wherein the step of loosening includes rotating the roll about a longitudinal axis of the roll, and the method further includes the steps of detecting the tail at the tail supporting surface and terminating the substep of rotating the roll after the tail is detected at the tail supporting surface.

15. The method of claim 11, wherein the step of loosening includes directing air toward the roll to unroll the tail from the roll.

16. The method of claim 11, further including the step of applying adhesive to the tail.

17. The method of claim 11, further including the steps of detecting the presence of a tail at the tail supporting surface and terminating the flowing step after the tail is detected at the tail supporting surface.

18. An apparatus for separating the tail from a roll of material, the apparatus comprising:

means for rotating a roll of material about a longitudinal axis of the roll;

means for loosening a tail from the roll;

a tail supporting surface; and means for extending the tail along the tail supporting surface, the tail extending means including at least one air duct positioned to flow air between the tail and the tail supporting surface.

19. The apparatus of claim 18, wherein the air duct positioned to flow the air over the tail supporting surface in a direction facing generally away from a roll of material being rotated by the rotating means.

20. An apparatus for separating a tail from a roll of material the apparatus comprising:

rotator for rotating a roll of material about a longitudinal axis of the roll;

a tail loosener for loosening a tail from a roll of material being rotated by the rotator;

a tail supporting surface positioned adjacent to the rotator; and at least one air duct positioned to flow air over the tail supporting surface between the tail and the tail supporting surface, the air duct facing in a direction generally away from the roll being rotated by the rotator.

* * * * *

UNITED STATES PATENT AND TRADEMARK OFFICE

CERTIFICATE OF CORRECTION

PATENT NO. : 5,679,206
DATED : October 21, 1997
INVENTOR(S) : GLASS

It is certified that error appears in the above-indentified patent and that said Letters Patent is hereby corrected as shown below:

Claim 20, col. 8, line 15, before "rotator" insert --a--.

Signed and Sealed this

Twenty-third Day of December, 1997

*Attest:*

*Attesting Officer*

BRUCE LEHMAN

*Commissioner of Patents and Trademarks*